US007219589B2

(12) United States Patent
Gibson et al.

(10) Patent No.: US 7,219,589 B2
(45) Date of Patent: May 22, 2007

(54) BOMB FUZE EVENT INSTRUMENTATION

(75) Inventors: Mark W. Gibson, St. Peters, MO (US); Robert L. Grant, St. Peters, MO (US); Jill J. Powers, Troy, IL (US); Donald G. Gerard, St. Charles, MO (US); Joseph J. Molinari, Florissant, MO (US); Gary F. Throm, St. Louis, MO (US); Tom Dellamano, Collinsville, IL (US); Fred G. Filsinger, St. Peters, MO (US)

(73) Assignee: The Boeing Company, Chicago, IL (US)

( * ) Notice: Subject to any disclaimer, the term of this patent is extended or adjusted under 35 U.S.C. 154(b) by 356 days.

(21) Appl. No.: 10/837,200

(22) Filed: Apr. 30, 2004

(65) Prior Publication Data

US 2007/0039454 A1 Feb. 22, 2007

(51) Int. Cl.
*F41F 5/00* (2006.01)

(52) U.S. Cl. ..... 89/1.11; 102/380

(58) Field of Classification Search ..... 89/1.11; 102/380; 367/127–128
See application file for complete search history.

(56) References Cited

U.S. PATENT DOCUMENTS 2,958,284 A * 11/1960 Richardson ..... 102/217
3,476,938 A * 11/1969 Falbel et al. ..... 250/338.1
3,685,347 A * 8/1972 Hildebrant et al. ..... 73/35.16
3,772,594 A * 11/1973 Kuehnast ..... 324/72
4,138,660 A * 2/1979 Hill ..... 367/127
4,552,533 A * 11/1985 Walmsley ..... 434/12
4,833,495 A 5/1989 Ohmura et al.
4,890,130 A 12/1989 Takei et al.
4,954,857 A 9/1990 Mochida et al.
4,972,649 A 11/1990 Mochida et al.
4,991,509 A * 2/1991 Smith ..... 102/213

(Continued)

FOREIGN PATENT DOCUMENTS

FR 2567261 A1 * 1/1986

(Continued)

OTHER PUBLICATIONS

Siefke, Wanda, Chief, Fuze Division, AAC/WMGS; *Precision Strike SPO*; slide presentation; Apr. 9, 2003; 32 pages.

(Continued)

*Primary Examiner*—Troy Chambers
(74) *Attorney, Agent, or Firm*—Harness, Dickey & Pierce, P.L.C.

(57) ABSTRACT

An assembly for indicating when a transient electronic event has occurred on a mobile platform is provided. The assembly includes a housing and a flash-producing device that communicates with the mobile platform and produces a flash approximately when the event occurs. The housing couples to the body of the mobile platform and contains the flash-producing device in such a manner that the flash is observable. Preferentially, the assembly also includes a faceplate that couples to the housing and maintains an aerodynamic profile associated with a surface of the body when the assembly is coupled to the mobile platform. In another preferred embodiment, the assembly is adapted for use with an inert JDAM weapon and the event is the fuze command of the weapon.

20 Claims, 6 Drawing Sheets

U.S. PATENT DOCUMENTS

| | | | | |
|---|---|---|---|---|
| 5,235,364 | A | 8/1993 | Ohmura et al. | |
| 5,537,909 | A * | 7/1996 | Schneider et al. | 89/1.11 |
| 5,546,358 | A * | 8/1996 | Thomson | 367/128 |
| 5,782,429 | A * | 7/1998 | Mead | 244/3.11 |
| 5,793,889 | A * | 8/1998 | Bushman | 382/221 |
| 5,936,188 | A * | 8/1999 | Atkinson | 102/380 |
| 5,970,024 | A * | 10/1999 | Smith | 367/128 |
| 6,000,340 | A * | 12/1999 | Small | 102/380 |
| 6,453,790 | B1 * | 9/2002 | Cesulka et al. | 89/1.11 |
| 6,510,776 | B2 * | 1/2003 | Sirmalis et al. | 89/1.11 |
| 6,604,584 | B2 * | 8/2003 | Lerche et al. | 175/4.55 |
| 6,621,764 | B1 * | 9/2003 | Smith | 367/128 |
| 6,738,012 | B1 * | 5/2004 | Kirkpatrick | 342/67 |
| 6,928,916 | B2 * | 8/2005 | Witte et al. | 89/1.11 |
| 6,980,152 | B2 * | 12/2005 | Steadman et al. | 342/14 |
| 7,104,496 | B2 * | 9/2006 | Chang | 244/3.19 |
| 2002/0166442 | A1 * | 11/2002 | Sirmalis et al. | 89/1.11 |
| 2006/0239120 | A1 * | 10/2006 | Berkovich et al. | 367/128 |

FOREIGN PATENT DOCUMENTS

JP 01266499 A * 10/1989

OTHER PUBLICATIONS

Hornberger, Bruce, NAWC/WD China Lake; *Joint Advanced Missile Instrumentation* (*JAMI*) *System Flight Termination Safe and Arm*; slide presentation; Apr. 13, 2000; 19 pages; NDIA Fuze Conference.

Harris, Tom; *How Camera Flashes Work, Making a Flash*; Internet article; undated, 4 pages, www.electronics.howsturffworks.com/camera-flash1.html; HowStuffWorks.

Harris, Tom; *How Camera Flashes Work, The Boost;* Internet article; undated, 3 pages, www.electronics.howsturffworks.com/camera-flash2.html; HowStuffWorks.

Harris, Tom; *How Camera Flashes Work, Oscillator and Capacitor*, Internet article; undated, 4 pages, www.electronics.howsturffworks.com/camera-flash3.html; HowStuffWorks.

Global Security.Org; *Joint Direct Attack Munition* (*JDAM*); Internet article; undated; 5 pages; www.globalsecurity.org/military/systems/munitions/jdam-pics.htm.

Global Security.Org; *Joint Direct Attack Munition* (*JDAM*) *Operations*; Internet article; undated; 3 pages; www.globalsecurity.org/military/systems/munitions/jdam-ops.htm.

Global Security.Org; *Joint Direct Attack Munition* (*JDAM*) *Degisn*; Internet article; undated; 4 pages; www.globalsecurity.org/military/systems/munitions/jdam-design.htm.

F-16.NET; *Joint Direct Attack Munition, GBU-29/30/31/32 JDAM*; Internet article; undated; 9 pages; www.f-16.net/f-16_armament_article9.html.

Boeing Company; *Joint Direct Attack Munition*(*JDAM*); Internet pages; undated 3 pages; www.boeing.com.

Rubycon; Aluminum Electrolytic Capacitors Product List; undated, 2 pages.

* cited by examiner

-3 SCHEMATIC

BOMB FUZE EVENT INSTRUMENTATION

FIELD OF THE INVENTION

This invention relates generally to event detection instrumentation and, more particularly, to instrumentation for detecting the command to initiate a fuze of an air-to-surface weapon.

BACKGROUND OF THE INVENTION

During the development of the Joint Direct Attack Munition (JDAM) a need arose to precisely determine when the munition's fusing mechanism under test generated a firing command to trigger the warhead of the weapon. Since the tested weapons were outfitted with inert warheads, a non-explosive method was required to demonstrate fuze functionality.

JDAM weapons are designed to be carried aloft while attached to a store point of an aircraft or in the aircraft's bomb hold. Each JDAM includes an unguided (i.e. "dumb") bomb and a kit attached thereto that includes a Global Positioning System (GPS) based guidance subsystem. The guidance subsystem includes adjustable fins, actuators, a processor, and other associated components that convert the bomb to a guided (i.e. "smart") weapon. Service personnel typically load the JDAMs on to the aircraft hours before the intended use of the weapon. At some time prior to release, the GPS coordinates of the intended target are loaded into the guidance system. The aircraft then flies to the vicinity of the target and releases the weapon at a location that is pre-calculated to allow the weapon to fall toward the target. While the JDAM is falling, the guidance system adjusts the trajectory of the weapon to cause it to strike the target with little, or no, positioning error. At a pre-selected altitude nearly coincident with the weapon's impact, the fuze receives a signal from an on-board DSU-33 (radar altimeter) that indicates that the desired height above the ground has been achieved and the fuze under test initiates the fire signal to a "simulated" explosive charge. The fuze initiates upon receiving the command from the DSU-33 and, if explosives are included in the warhead, triggers the explosive material. Because the bomb typically falls at a speed approaching Mach 1, the pre-selected altitude allows the explosion to propagate through the explosive material in such a manner as to cause the weapon to explode within a short distance from the target. Thus, the JDAM kit allows the user to convert an unguided weapon to a low cost guided weapon with precision strike capabilities. Such precision strike weapons guidance subsystems are available from the Boeing Company of Chicago, Ill.

To keep unit costs low, and to avoid undesirable modifications of the associated aircraft (e.g. the addition of a power umbilical), the JDAM is designed to be self sufficient, particularly with regard to power. Thus, each JDAM includes a 28-volt thermal battery to power the guidance subsystem. Because it is likely that the JDAMs will be stored on the aircraft for many hours prior to their use, the power supplied by the thermal battery must be reserved for the guidance system.

Nonetheless, it is still necessary to know within about 1 foot of altitude when the fuze commands the detonation to determine the reliability of the fuze, particularly with regard to the timing of the explosion vis-a-vis the approach of the weapon to the target. Thus, a telemetry system is typically added to the test JDAM to transmit the weapon fuze command, engineering information, and other data to the test data system. Unfortunately, as the JDAM nears the ground, the telemetry signal reflects off of the ground and structures thereabout. These reflections interfere with the original signal and therefore cause loss of the transmitted data. The transmitted fuze command suffers disproportionately from this interference because it typically occurs within a few feet of the ground where such multi-path interference is most severe. Thus, a need exists to reliably and precisely determine when and where the fuze command occurred even with the presence of multi-path interference with the telemetry signal.

SUMMARY OF THE INVENTION

It is in view of the above problems that the present invention was developed. The invention provides systems and methods for determining when a transient electronic event occurs on a mobile platform. More particularly, the invention provides systems and methods for determining when a fuze command occurs on a weapon.

In a first preferred embodiment, a flash assembly is provided for indicating when a transient electronic event occurs on a mobile platform and is recorded by an optical motion recording device. Herein, the term "mobile platform" refers to apparatus for transporting payloads such as people or cargo (e.g. a warhead). Thus, for example, aircraft, weapons, and projectiles are included in the term "mobile platform." The assembly includes a housing and a flash-producing device that communicates with the mobile platform and produces a flash approximately when the event occurs. The housing couples to the body of the mobile platform and contains a flash-producing device in such a manner that the flash is observable. Preferentially, the assembly also includes a faceplate that couples to the housing and maintains an aerodynamic profile associated with a surface of the body. In another preferred embodiment, the assembly is adapted for use with a JDAM weapon and the event is the occurrence of the weapon's fuze command. The optical recording device (e.g. motion picture camera or video camera) preferentially has a shutter speed fast enough to record the occurrence of the event within the desired accuracy.

The present invention also provides a mobile platform including a flash-producing assembly thereon. The flash assembly communicates with the fuze command and is triggered to flash when the fuze command occurs. In a preferred embodiment, six flash assemblies positioned around the circumference of the weapon are wired in parallel. Thus, a single optical recording device can record the event despite the orientation of the weapon when the command occurs.

More particularly, each of the flash assemblies includes a housing that is adapted to be inserted into the body of the weapon. A preferred embodiment provides a warhead component of a JDAM weapon that has been modified to accept the flash assemblies. Likewise, the warhead component is adapted to receive a battery assembly (e.g. a 1.2 VDC battery), a fuze command distributor assembly, and a set of cables to connect them to the flash assemblies. In operation, the distributor accepts power from the battery and passes it to the flash assemblies. Additionally, the distributor accepts the fuze command from the weapon, amplifies it, and fans it out to the flash assemblies. In another preferred embodiment, the distributor, (preferentially a low current device) communicates with the 28 volts-direct current (VDC) thermal battery of the weapon, but only to sense the status of the weapon for switching the 1.2 VDC flash subsystem battery power on and off. Thus, the flash assemblies draw power only from the 1.2 VDC battery provided herein.

In yet another preferred embodiment, a flash assembly is provided. The flash assembly includes a capacitor, a voltage comparator, an oscillator, a switch, an opto-isolator, and a flash tube. The assembly is connected to a 1.2 VDC battery via an external cable set and a fuze command distributor. The battery power flows first to the oscillator where it is stepped up in voltage and then it flows to the capacitor. When the opto-isolator receives the fuze command it is configured to trigger the flash tube thereby discharging the capacitor. Thus, the assembly produces an external indication (a flash) that the fuze command has occurred. Preferably, the voltage comparator communicates with the capacitor to sense the voltage there across. The comparator also communicates with the switch to control the flow of low voltage current to the oscillator. Thus, when the comparator senses that the charge on the capacitor has partially dissipated, the comparator drives the switch to cause the oscillator to re-charge the capacitor. When the capacitor is fully charged the comparator switches the charging circuit off. Thus, weapons constructed in accordance with the current embodiment possess the ability to conserve the power stored by the low voltage battery. Because of this power-saving feature, the present invention provides subsystems that may operate for periods up to about eight hours without requiring a new (or re-charged) battery.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
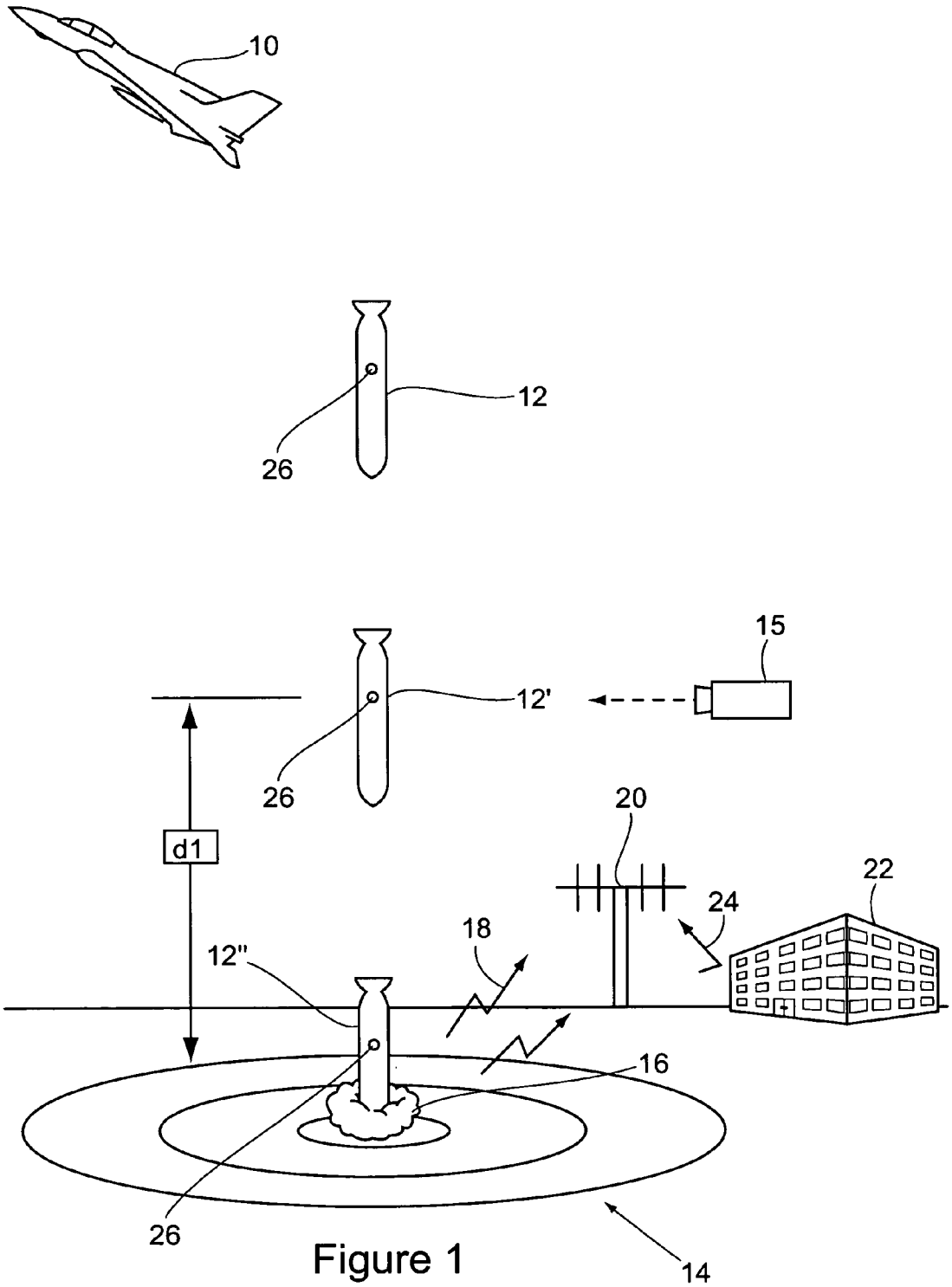
FIG. 1 illustrates a weapon constructed in accordance with a preferred embodiment of the present invention.

Referring to the accompanying drawings in which like reference numbers indicate like elements. FIG. 1 illustrates a weapon constructed in accordance with a preferred embodiment of the present invention.

FIG. 1 shows an aircraft 10 after releasing a weapon 12 at a target 14. The weapon 12 falls through the positions where it is designated as 12, 12', and 12" for the purpose of destroying the target 14 with an explosion 16. A telemetry stream 18 transmitted from the weapon 16 to a receiver 20 is also shown schematically along with a nearby structure 22. The structure 22 and ground create reflections 24 of the telemetry signal 18, the receipt of which by the receiver 20 interferes with the proper receipt of the original telemetry signal 18. Thus, the reliability of the telemetry signal degrades as the bomb moves toward the ground and the structures 22.

To cause the explosion 16 to occur at an optimal time, the weapon 12 generates an internal fuze initiation command when the weapon 12 passes through the location at a distance d1 from the target 14. The distance d1 is preselected such that the subsequent propagation of the explosion 16 through the warhead occurs while the weapon 12 falls through the distance d1. When the weapon is configured to test fuzes (i.e. the weapon includes flash assemblies 26 and an inert war head), a signal from the fuze as the weapon passes d1 causes the flash assembly 26 to illuminate. A high speed film or video camera records the event. Depending on the characteristics of the weapon 12 and the target 14, the explosion 16 may be timed to occur above, at, or below the surface of the target 14. Therefore, the location/altitude of the explosion 16 is critical and must be known with great accuracy (for example, within one foot or 0.001 seconds of its occurrence). In the presence of the reflections 24, such stringent accuracy may not be guaranteed by the telemetry system. Further, because the command (or at least the leading edge) is a transient electronic event that is internal to the weapon, no indication of its occurrence may be available if the telemetry signal fails.

Figure 2:
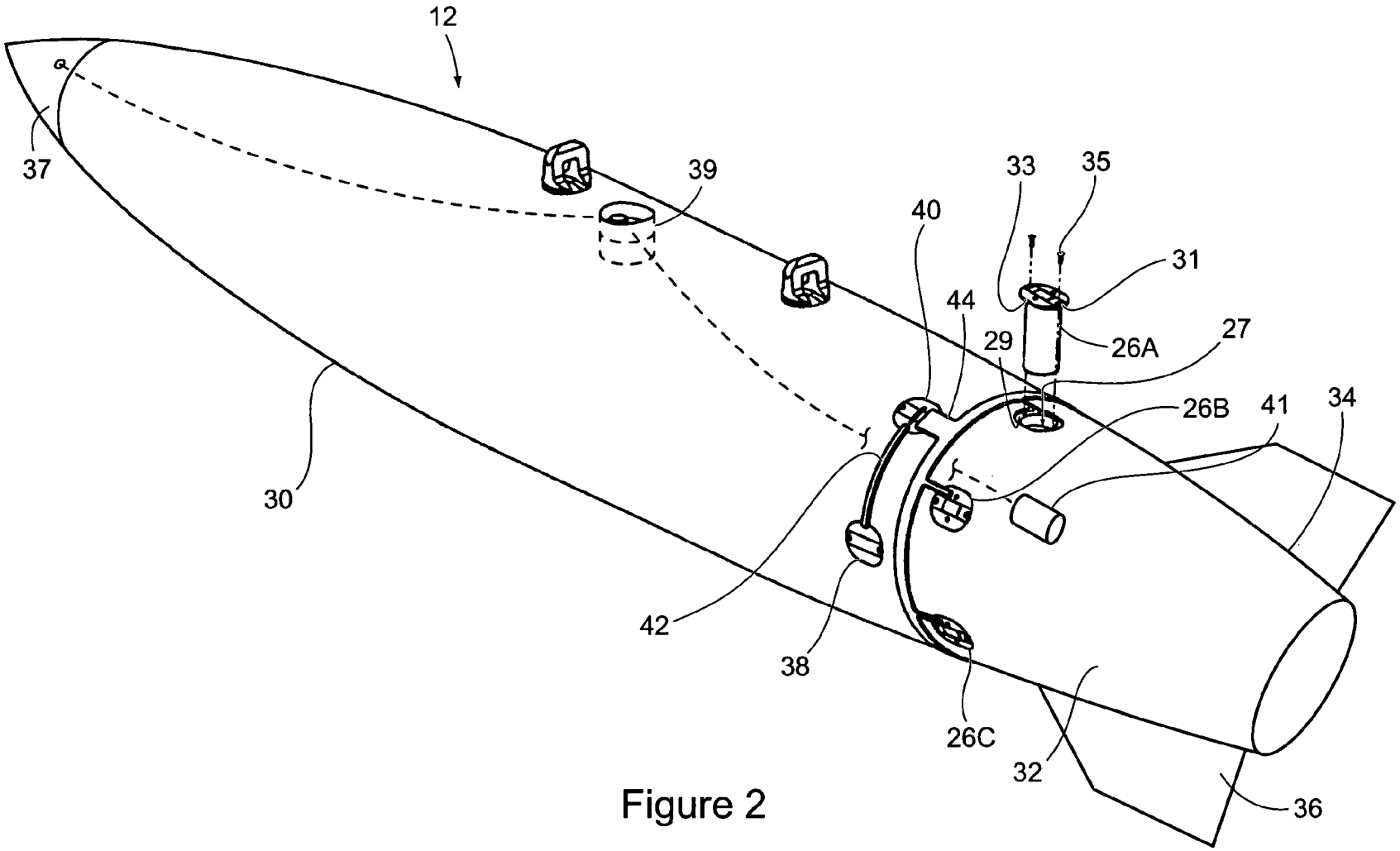
FIG. 2 illustrates a perspective view of the weapon of FIG. 1.

With reference now to FIG. 2, a perspective view of the weapon 12 is illustrated. The weapon 12 includes a plurality of flash assemblies 26, an inert warhead 30, a JDAM kit 32 that includes a tail section 34 with fins 36, a battery 38, a fuze command distributor 40, and a set of cables 42 and 44 (shown with cowlings providing mechanical protection and streamlining thereto). The weapon 12 also includes a proximity/radar altimeter 37, a fuze initiator 39, and a fuze 41 (which may be, respectively, a DSU-33 proximity/radar altimeter 37 and a FZU-55 fuze initiator). The inert warhead 30 (used for test purposes), preferably does not contain a charge of explosive material. The JDAM kit 32 couples to the aft end of the inert warhead 30. Within the JDAM kit 32, a GPS guidance system receives GPS signals and accurately determines the current location of the weapon 12. The JDAM kit 32 also contains a processor and memory such that the guidance subsystem knows the GPS coordinates of the target and the flight control characteristics of the weapon 12 thereby enabling the JDAM kit to fly the weapon to the target. The JDAM kit also provides power to the telemetry system. Around the outer circumference of the inert warhead 30, the flash assemblies 26 are spaced apart and positioned to be visible to observers. The tail section 34 is located at the aft end of the JDAM kit 32 and holds the fins 36 in adjustable relation to the weapon 12 for controlling the trajectory of the weapon 12.

Additionally, the inert warhead 30 shown is modified to include an aperture 27 with a recess 29 around the outer end of the aperture 27. The flash assembly 26 includes a flange 291 (see FIG. 6) extending from a faceplate 233 and that is adapted to fit within the recess 29. A pair of conventional fasteners 235 is also shown for securely coupling the flash assembly 26 to the inert warhead 30.

In operation, the battery 38 supplies power to the distributor 40 via cable 42. The distributor 40 allows the power to flow through cable 44 to the flash-producing devices 26 to keep a sufficient charge stored therein for powering the flash (as will be discussed in detail). The processor continuously computes the trajectory necessary to cause the weapon 12 to fall to the target based on the current location of the weapon 12 and the flight characteristics of the weapon 12.

If the weapon's trajectory begins to deviate from that necessary to strike the target, the processor adjusts the position of the fins 36 to correct for the error. This self-guiding capability is particularly useful on weapons 12 because it allows the weapon 12 to possess precision strike capabilities at low cost. Some time prior to approaching the target 14, the initiator 39 arms the fuze 41. As the pre-selected distance d1 is reached, the altimeter 37 signals the initiator 39. The initiator 39, upon sensing the signal, commands the fuze 41 to initiate. In turn, the fuze 41 triggers the warhead 30. For live warheads, the resulting explosion is timed to maximize damage to the target 14. But for fuze tests, the warhead 30 is inert. Thus, the distributor 40 is configured to receive the fuze fire signal, amplify it, and pass it on to the flash assemblies 26 with no appreciable delay. The distributed fuze command then communicates through the cable 44 and triggers the flash assemblies 26 which a high speed camera 15 (see FIG. 1) records for determining when the flash occurred. From the occurrence of the fuze command to full flash brilliance less than about 160 microseconds passes. At the speed of the weapon, this time is acceptable for meeting the accuracy requirements of the test.

Figure 3:
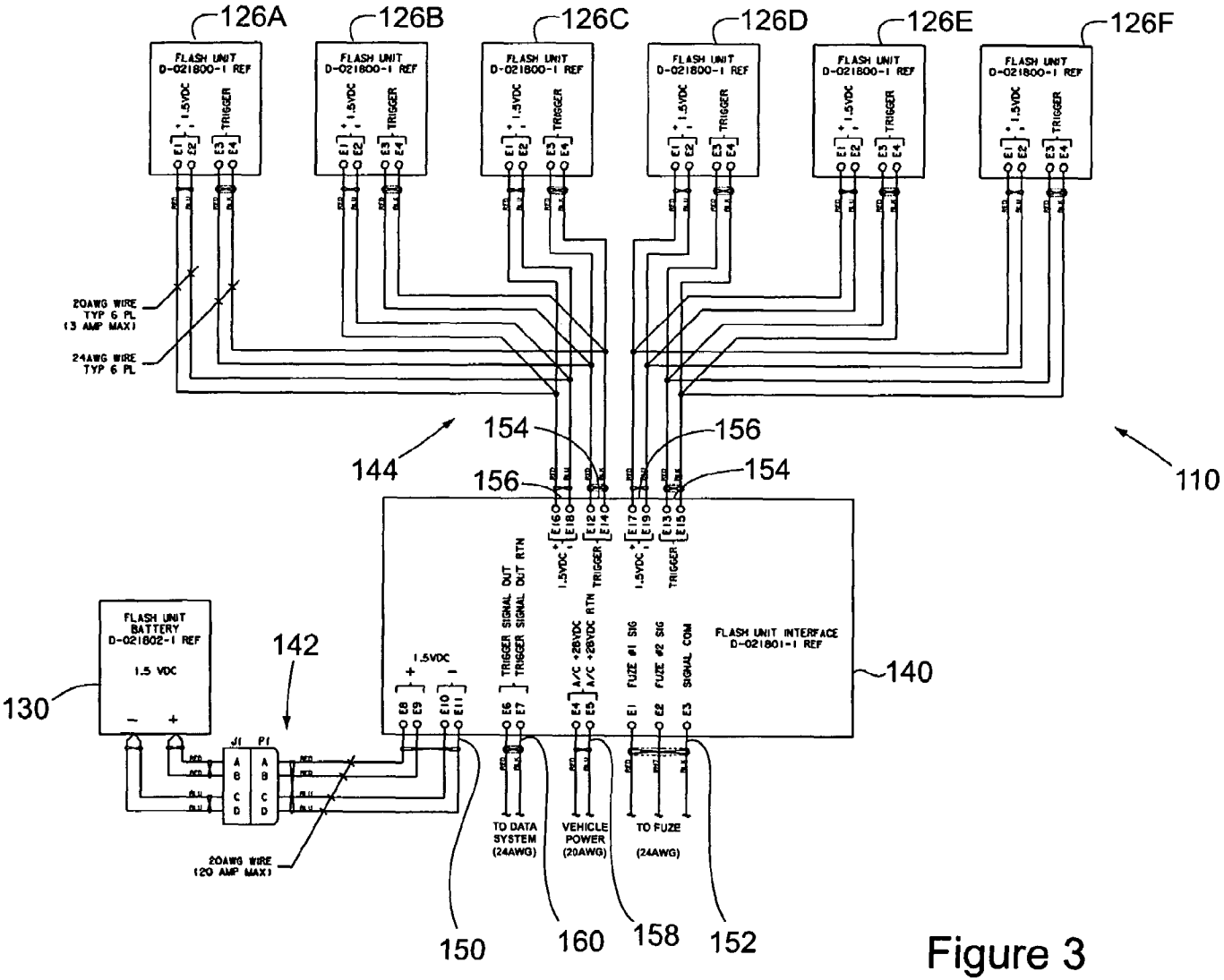
FIG. 3 illustrates a schematic of a preferred embodiment of the present invention.

With reference now to FIG. 3, the interconnecting wiring of an event detection subsystem 110, that is constructed in accordance with the principles of the present invention, is shown. The subsystem 110 includes a plurality of flash-producing devices 126, a low voltage battery 130, and a fuze command and power distributor 140. A cable 142 provides a path for the power from the battery 130 to reach the distributor 140. Another cable 144 provides connectivity between the distributor 140 and the flash assemblies 126. The distributor includes a number of interfaces to the other cooperating components to form the subsystem 110. First, the cable 142 connects to a low voltage power input 150 for accepting power from the battery 130. Likewise, the command from the fuze enters the distributor 140 at a command (or event) input 152. In a preferred embodiment, the distributor 140 is configured to accept the fuze command from either of two sources via a three pin interface 152. Opposite the inputs 150 and 152, FIG. 3 shows at least one fuze command output 154 and at least one low voltage power output 156. These are shown being connected to the cable 144. Thus, when a flash assembly 126 needs to re-charge, it draws power from the battery 130 through the distributor 140, as shown. Similarly, the fuze command reaches the flash assemblies 126 via the distributor 140.

Another output 160 is shown for communicating the distributed fuze command to the weapon's data and telemetry subsystem. Preferably, the distributor 140 also includes an input 158 through which the distributor 140 senses whether the weapon is active by the presence of the weapon's 28 VDC power supply.

Figure 4:
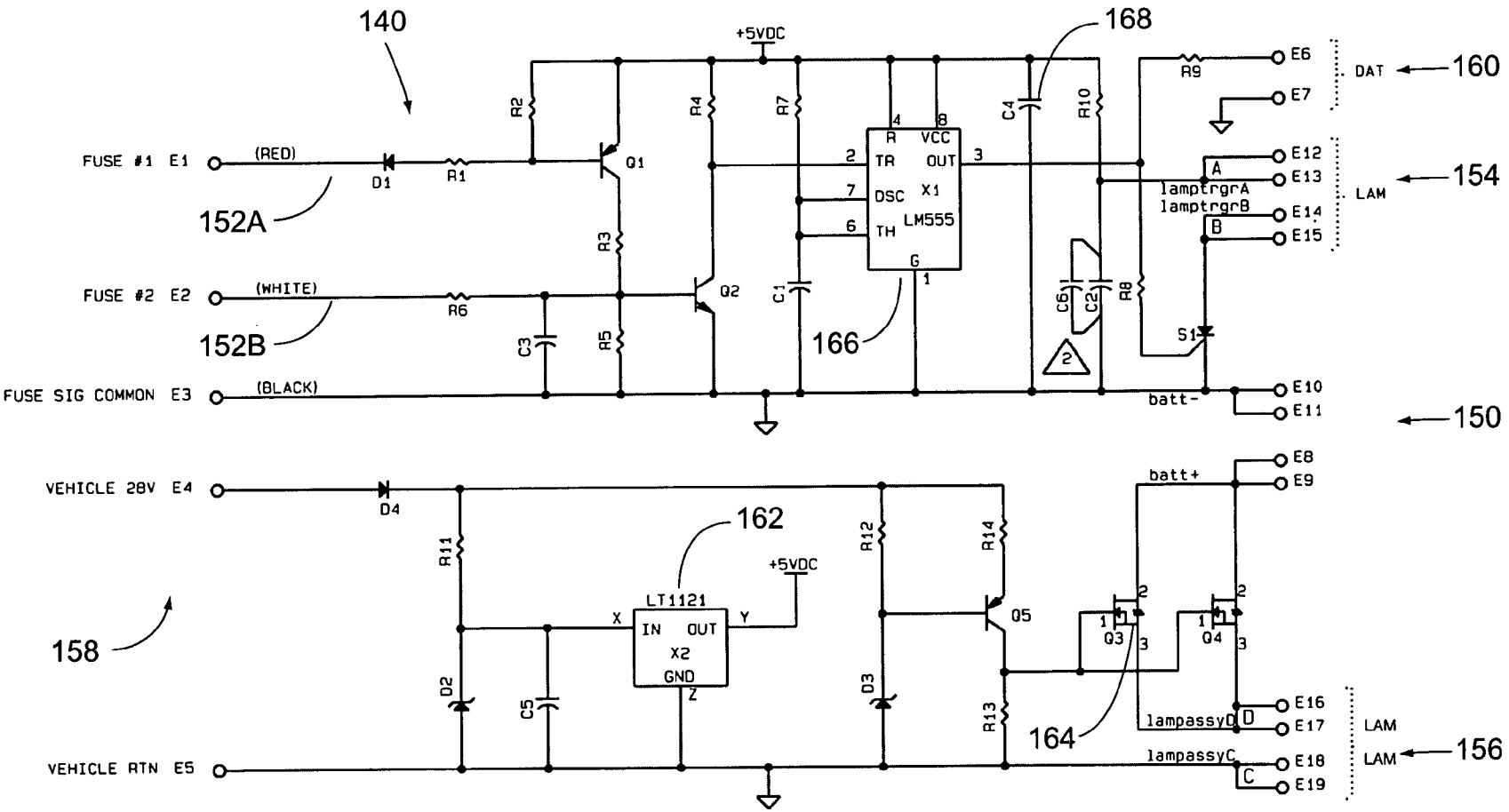
FIG. 4 illustrates a schematic of another preferred embodiment of the present invention.

With reference now to FIG. 4, an internal schematic of a preferred distributor 140 is shown. The distributor 140 includes a voltage regulator 162, a pair of FET transistors 164, a timer 166, and a capacitor 168. When connected as shown, transistors 164 sense whether the weapon is active by determining whether the weapon's 28 VDC power is present. The purpose of the power sensing section of the distributor 140 is to allow power to pass from the battery input 150 to the low voltage output 156 if the weapon is active (i.e. powered). If the weapon is not active (i.e. un-powered) then no low voltage power is allowed to flow from the battery 130 to the flash assemblies 126. Thus, the power from the low voltage battery 130 is conserved while the weapon is inactive. Meanwhile, the voltage regulator 162 serves to create 5V to power the fuze detection circuitry and signals to the flash assemblies.

In the other portion of the schematic of FIG. 4, the fuze command input 152 accepts the fuze command and is connected to the timer 166. Preferably, the fuze command input 152 includes provisions to accept both a command that transitions from a "low" condition to a "high" condition and a command that transitions from high to low to initiate the fuze. As shown, either type of command triggers the timer 166 with one input, here 152B being inverted prior to triggering the timer 166. In addition to being triggered by the fuze command input 152, the output of the timer 166 is connected to the fuze command output 154 and telemetry output 160. Preferably capacitors, such as capacitor 168, are included in the distributor to prevent transients from triggering the timer 166. Thus, upon receipt of a fuze command, the timer 166 outputs a pulse of a pre-selected length that is communicated to the fuze command outputs 154 and telemetry output 160.

Figure 5:
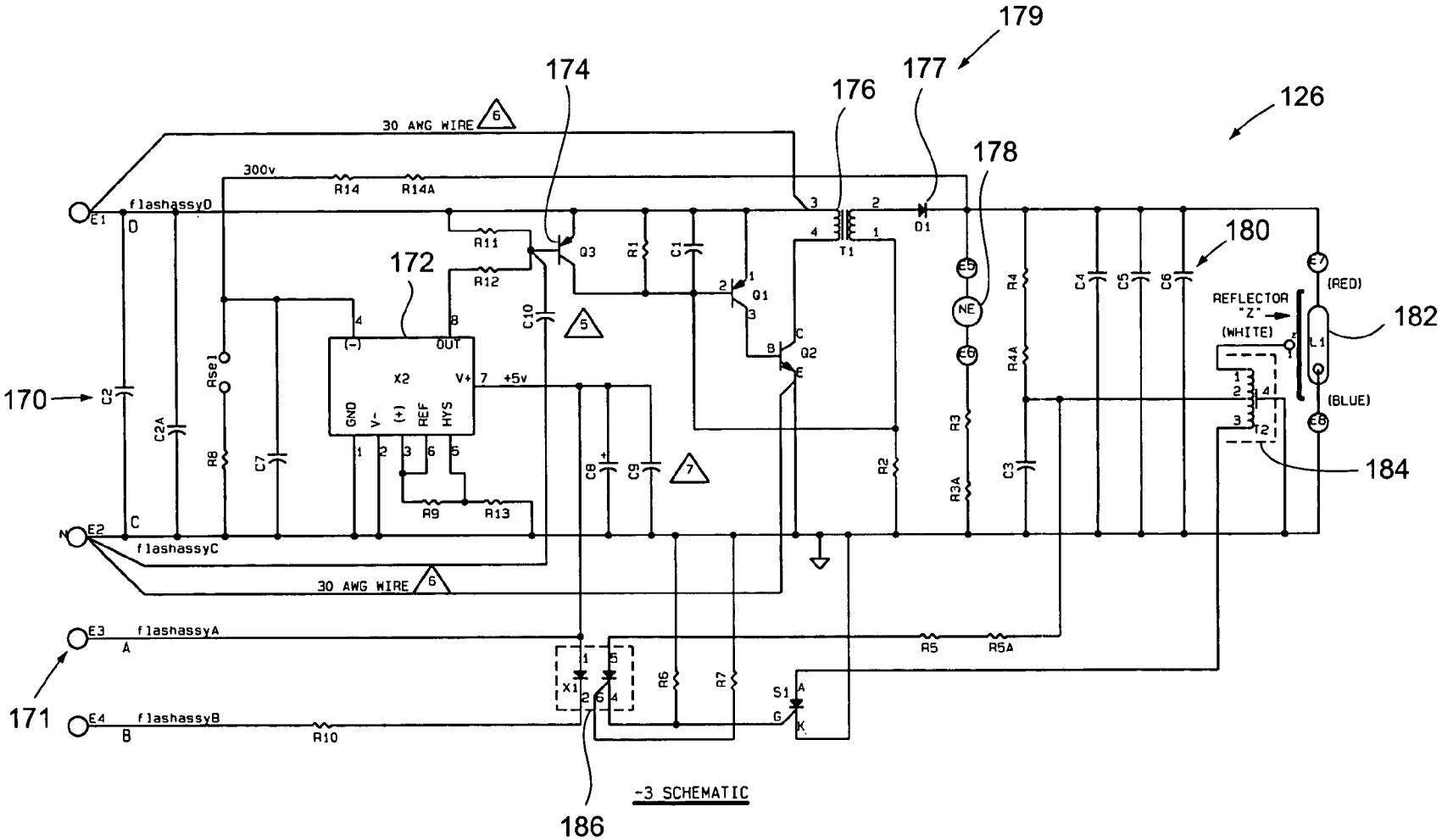
FIG. 5 illustrates a schematic of yet another preferred embodiment of the present invention.

FIG. 5 illustrates a schematic of a flash assembly 126 constructed in accordance with another preferred embodiment of the present invention. The flash-producing device 126 includes a low voltage power input 170, a fuze command input 171, a comparator 172, a high frequency switch 174, a transformer 176, a diode 177, an indicator 178, three capacitors 180, a flash tube 182, a flash tube trigger 184, and an opto-isolator 186. As shown, the comparator 172 is configured to sense the voltage stored on the capacitors 180 and to control the switch 174. The switch 174, the transformer 176, and the diode 177 are configured as an oscillator 179 connected between the low voltage power input 170 and the capacitors 180. Of course, the flash tube is connected in parallel with the capacitors 180. In another portion of FIG. 4, the distributor 140, the opto-isolator 186 provides a communication path between the fuze command input 171 and the flash tube trigger 184 as shown.

In operation, the comparator 172 determines when the voltage across the capacitors 180 has decreased to a pre-selected amount indicative of a partial discharge of the capacitors 180. When the voltage is low, the comparator 172 biases the switch 174 to an "on" condition, thereby causing the oscillator 179 to generate a pulse of high voltage current that replenishes the charge stored on the capacitors 180. Thus, the oscillator 179 steps up the low voltage current from the battery to the operating voltage of the flash tube 182. Preferably, the indicator 178 is configured to produce an observable indication (e.g. a visible neon lamp) when the voltage reaches the minimum operating voltage of the flash tube 182. When the fuze command arrives from the timer 166 of the distributor 140 (see FIG. 4), the opto-isolator 186 converts the electric pulse to an optically isolated, constant, electric signal that is supplied to the trigger 184. The trigger 184 steps up the signal from the opto-isolator 186 and causes the flash tube 182 to begin conducting the high voltage charge stored on the capacitor 180. Thus, the flash-producing device 126 produces an external flash to indicate that the fuze command has occurred. In operation it has been found that subsystems constructed in accordance with the principles of the present invention generate flashes suitable for recording with high-speed cameras within about 159 microseconds of the occurrence of the fuze command. The flash duration (about 0.003 seconds) is long enough to be recorded by a camera at a high frame rate.

In another preferred embodiment of the present invention readily available commercial products may be disassembled to obtain the components from which to assemble the flash assemblies 126 disclosed herein. For instance, a flash tube subassembly (including a reflector, a trigger 184, and a step-up transformer associated with the trigger), an indicator 178, and transformer 176 may be extracted from a model 887 1428 Single Use camera available from the Kodak Company of Rochester, N.Y. The capacitors 180 are preferably 120 uF, 330 volt, PHOTO-FLASH capacitors available from Rubycon America, Inc. of Gumee, Ill. Preferably, the opto-isolator 186 is a model number H11C6 opto-isolator available from the Digi-Key Corp. of Thief River Falls, Minn. The comparator 172 is preferably a MAX971 CSA comparator available from the Maxim Integrated Products of Sunnyvale, Calif.

Figure 6B:
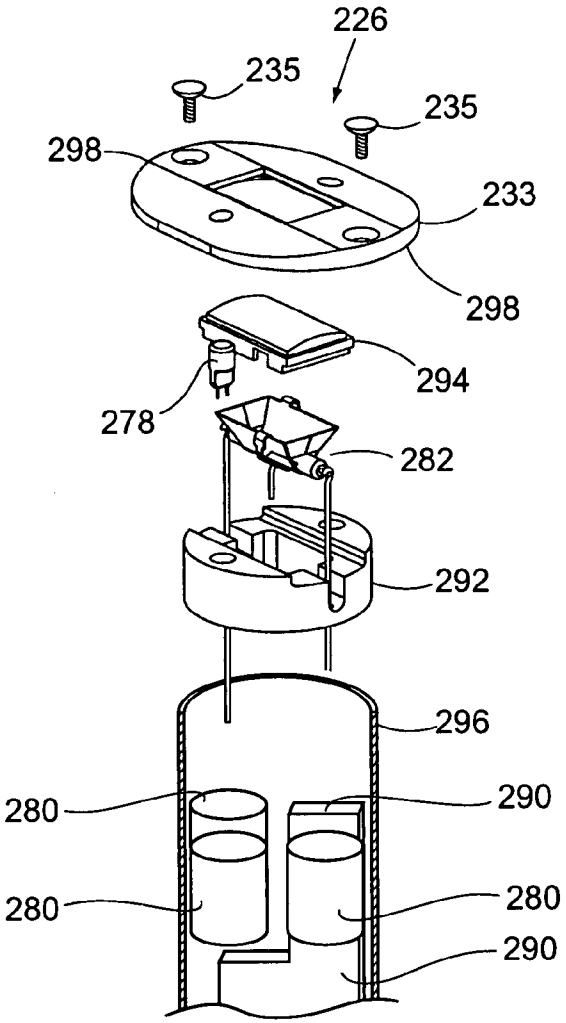
FIG. 6 illustrates a flash assembly constructed in accordance with a preferred embodiment of the present invention.
Figure 6A:
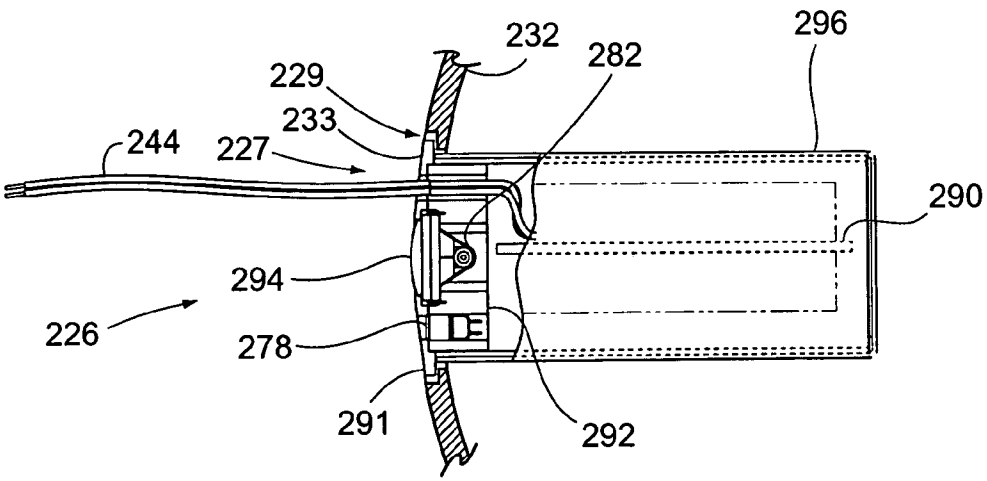

For the distributor 140 of FIG. 4, a preferred embodiment includes components from the following sources. The timer 166 may be a model LMC555CM timer available from the Phillips Semiconductor of Eindhoven, The Netherlands. The voltage regulator 162 may be a model LT1121IZ-5 voltage regulator also available from the Digi-Key Corp. Additionally, the battery 130 may be a model RC-3000HV sub-C, 1.2 volt, high power battery available from the Sanyo Energy (USA) Corporation of San Diego, Calif. While certain components have thus been described, any combination of components suitable for producing a flash or distributing the power or fuze command, as herein described, may be used. With reference now to FIG. 6, another preferred embodiment of the present invention is illustrated. FIG. 6*a* shows a flash assembly 226, in relation to a weapon warhead, whereas FIG. 6*b* shoes an exploded view of the flash assembly 226. The flash assembly 226 includes three capacitors 280, a flash tube 282, a printed circuit board 290, and an adapter 292. A faceplate 233, an indicator 278, a lens 294, and a housing 296, are also shown. Generally, the housing 296 contains the other components with the faceplate 233 closing one end of the cylindrical housing 296. Of the three capacitors 280, one is positioned in a notch in the printed circuit board 290 and the other two reside adjacent to the circuit board 290. All three capacitors 280 are electronically connected to the circuit board in accordance with the schematic diagram illustrated by FIG. 5. The adapter 292 holds the capacitors 280, the circuit board 290, and the flash tube 282 in fixed relation to each other and to the housing 296. The flash tube 282 and the indicator 278 are, of course, also connected to the printed circuit board 290 in accordance with FIG. 5.

As shown by FIG. 6, the lens 294 fits over the flash tube 282 subassembly and serves to focus and intensify the light generated by the flash tube 282. When the faceplate 233 is coupled to the end of the housing 296 it holds the flash tube 282, the lens 294, and the indicator 278 in fixed relation to each other and the housing 296. Further, the faceplate 233 ensures that the flash tube 282 and indicator 278 are held in such a manner as to be visible from outside of the housing 296 as well as the aperture 227 of the inert warhead 30. Additionally, a cable 244 is shown routed from the housing 296, through the faceplate 233 for connection to a fuze command and power distributor (for example, distributor 140 of FIG. 4).

Generally, the flash assembly 226 is adapted to fit within an aperture 227 in the inert warhead 30. The faceplate 233 of the flash assembly 226 includes a flange 291 that engages a corresponding recess 229 around the top of the aperture 227. In particular, the oblong faceplate 233 includes a pair of lobes 298 extending from opposite ends of the faceplate 233 to form the flange 291. Further, when the faceplate 233 abuts the housing 296, the lobes 298 extend from opposite sides of the housing 296 for engagement with the recess 229 in the weapon. After the flange 291 is seated in the recess 229, a pair of fasteners 235 is used to securely couple the flash assembly 226 to the inert warhead 30. Because the lobes 298 rests in the recess 229 the aerodynamic profile of the weapon 12 is maintained. The battery and distributor may also be contained in similar housings with suitable faceplates coupled thereto to further preserve the aerodynamic performance of the weapon. Additionally, cowlings may cover the cables (shown at 42 and 44 in FIG. 2) between the battery, the distributor, and the flash assemblies to provide a flash subsystem compatible with the aerodynamic profile of the weapon.

In view of the foregoing, it will be seen that the several advantages of the invention are achieved and attained. A low cost approach to determine the time of a transient event on a mobile platform has been provided. In particular, a flash is produced on the mobile platform to provide an external indication of the time the event occurred. Additionally, the apparatus and methods disclosed herein may operate independently of the mobile platform for up to, and beyond, 8 hours. Thus, the invention requires no power (other than for sensing the status of the mobile platform, if desired) from the mobile platform until it is active, thereby obviating the need for a power umbilical from the mobile platform.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of detecting the occurrence of a transient electronic event on a mobile platform, comprising triggering the transient electronic event by movement of the mobile platform to a pre-selected distance from a destination of the mobile platform;

sensing the occurrence of the transient electronic event;

initiating a flash from the mobile platform within a pre-selected time from the occurrence of the transient electronic event;

detecting the occurrence of the flash; and determining a distance between the mobile platform and the destination at the time of the detecting.

2. The method according to claim 1, further comprising destroying the mobile platform.

3. The method according to claim 1, further comprising determining if a charge stored to produce the flash falls below a pre-selected level and, if so, then increasing the charge.

4. The method according to claim 1, further comprising transmitting a telemetry indication of the occurrence of the transient electronic event.

5. The method according to claim 1, wherein the mobile platform is a weapon.

6. The method according to claim 5, wherein the transient electronic event is a fuze command of the weapon.

7. A method for determining the occurrence of a transient electronic event associated with a moving mobile platform, wherein said mobile platform is traveling toward a target, the method comprising:

triggering the transient electronic event when the mobile platform has reached a predetermined distance from the target;

sensing the occurrence of the transient electronic event;

initiating a flash from a component carried on the mobile platform in response to said sensing of said transient electronic event; and using a detection of said flash to determine that the transient event has occurred.

8. The method of claim 7, further comprising recording said flash with a camera.

9. The method of claim 8, further comprising using said recording of said flash to determine a distance of said mobile platform from said target at the time said flash is initiated.

10. The method of claim 7, wherein sensing the occurrence of the transient event includes:

using a flash device to produce said flash;

using a battery housed on said mobile platform to power said flash; and distributing power from said battery to said flash when the occurrence of said transient electronic event has been sensed, to thus cause said flash device to produce said flash.

11. The method of claim 7, further comprising generating a plurality of flashes simultaneously from a corresponding plurality of locations on said mobile platform, at the occurrence of said transient electronic event.

12. The method of claim 7, further comprising transmitting telemetry information from said mobile platform as said mobile platform travels toward said target.

13. A method for determining the occurrence of a fuze command associated with a moving munition, wherein said munition is traveling toward a terrestrial-based target, the method comprising:

sensing an altitude of said munition as said munition travels toward said target;

at a predetermined altitude, generating the fuze command;

sensing the occurrence of the fuze command;

initiating an optical signal from a component carried on said munition in response to said sensing of said fuze command; and using a detection of said optical signal to determine that the fuze command has occurred.

14. The method of claim 13, further comprising using said detection of said optical signal to closely approximate a distance of said munition from said target at the approximate time that said optical signal was initiated.

15. The method of claim 13, further comprising causing said munition to generate telemetry commands to a remotely located facility to aid in guiding said munition toward said target.

16. The method of claim 13, wherein initiating said optical signal comprises generating a flash of light.

17. The method of claim 16, further comprising recording said flash of light.

18. The method of claim 13, further comprising simultaneously initiating a plurality of optical signals from predetermined locations on said munition in response to sensing of said fuze command.

19. The method of claim 13, further comprising using a battery carried on said munition to provide electrical power to assist in generating said optical signal.

20. The method of claim 13, further comprising:

using an electronic distribution system to monitor for the generation of said fuze command;

upon the generation of said fuze command, generating a plurality of electrical signals;

using said electrical signals to assist in generating a plurality of optical signals at spaced apart locations on said munition; and detecting at least one of said optical signals.

* * * * *